US010167807B2

(12) United States Patent
Probst

(10) Patent No.: US 10,167,807 B2
(45) Date of Patent: Jan. 1, 2019

(54) CONTROL UNIT OF AN INTERNAL COMBUSTION ENGINE

(71) Applicant: MAN Diesel & Turbo SE, Augsburg (DE)

(72) Inventor: Ulrich Probst, Wertingen (DE)

(73) Assignee: MAN Energy Solutions SE, Augsburg (DE)

( * ) Notice: Subject to any disclaimer, the term of this patent is extended or adjusted under 35 U.S.C. 154(b) by 0 days.

(21) Appl. No.: 15/120,339

(22) PCT Filed: Feb. 19, 2015

(86) PCT No.: PCT/EP2015/000372
§ 371 (c)(1),
(2) Date: Aug. 19, 2016

(87) PCT Pub. No.: WO2015/124304
PCT Pub. Date: Aug. 27, 2015

(65) Prior Publication Data

US 2017/0067408 A1 Mar. 9, 2017

(30) Foreign Application Priority Data

Feb. 20, 2014 (DE) ..... 10 2014 002 261

(51) Int. Cl.
*F02D 41/20* (2006.01)
*F02D 41/38* (2006.01)
*F02D 41/00* (2006.01)

(52) U.S. Cl.
CPC ..... *F02D 41/3809* (2013.01); *F02D 41/0002* (2013.01); *F02D 41/20* (2013.01);
(Continued)

(58) Field of Classification Search
CPC .... F02D 41/20; F02D 41/3809; F02D 41/002; F02D 2200/04; F02D 2041/2003;
(Continued)

(56) References Cited

U.S. PATENT DOCUMENTS 6,584,961 B2 * 7/2003 Marceca ..... F02D 41/20 123/472
6,785,112 B2 * 8/2004 Reischl ..... F02D 41/20 123/478

(Continued)

FOREIGN PATENT DOCUMENTS

CN 101482065 7/2009
EP 1179670 2/2002

(Continued)

OTHER PUBLICATIONS

Office Action dated Jun. 14, 2017 which issued in the corresponding Canadian Patent Application No. 2,940,208.

(Continued)

*Primary Examiner* — Lindsay Low
*Assistant Examiner* — George Jin
(74) *Attorney, Agent, or Firm* — Cozen O'Connor

(57) ABSTRACT

Control device of an internal combustion engine, namely, for controlling injectors or gas valves of a fuel supply system of the internal combustion engine, wherein the control device controls each injector for opening the same such that the voltage present at the respective injector changes between different voltage levels in a boost phase of the control as well as in a hold phase of the control, and wherein the control device controls the respective injector in the boost phase such that after reaching a defined boost current level the voltage present at the respective injector changes between a relatively low boost voltage level which is greater than zero
(Continued)

volts and a relatively high boost voltage level which is greater than a supply voltage of the control device.

6 Claims, 2 Drawing Sheets

(52) U.S. Cl.
CPC .... *F02D 41/0027* (2013.01); *F02D 2041/001* (2013.01); *F02D 2041/2003* (2013.01); *F02D 2200/04* (2013.01)

(58) Field of Classification Search
CPC ..... F02D 2041/2058; F02D 2041/2006; F02D 2041/2013; F02D 2041/001; F02D 2041/2017; F02D 2041/2051
See application file for complete search history.

(56) References Cited

U.S. PATENT DOCUMENTS

| | | | | |
|---|---|---|---|---|
| 8,599,530 | B2 * | 12/2013 | Onda | F02D 41/20 361/152 |
| 8,649,151 | B2 * | 2/2014 | Yamada | F02D 41/20 123/490 |
| 2002/0014223 | A1 | 2/2002 | Marceca et al. | |
| 2003/0010325 | A1 | 1/2003 | Reischl et al. | |
| 2011/0220069 | A1 * | 9/2011 | Hatanaka | F02D 41/20 123/490 |
| 2011/0222202 | A1 | 9/2011 | Onda et al. | |
| 2012/0194961 | A1 | 8/2012 | Yamada et al. | |
| 2016/0076498 | A1 | 3/2016 | Aono et al. | |
| 2016/0177855 | A1 * | 6/2016 | Kusakabe | F02D 41/20 123/490 |
| 2016/0237937 | A1 * | 8/2016 | Kusakabe | F02D 41/20 |

FOREIGN PATENT DOCUMENTS

| | | |
|---|---|---|
| EP | 2365202 | 9/2011 |
| EP | 2492478 | 8/2012 |
| JP | 2003-528251 | 9/2003 |
| JP | 2011-185365 | 9/2011 |
| JP | 2012-159049 | 8/2012 |
| WO | WO01/71174 | 9/2001 |
| WO | WO 2014/174916 | 10/2014 |

OTHER PUBLICATIONS

Office Action dated Aug. 28, 2017 which issued in the corresponding Japanese Patent Application No. 2016-553388.
Office Action dated May 4, 2018 which issued in the corresponding Chinese Patent Application No. 201580009644.X.

* cited by examiner

CONTROL UNIT OF AN INTERNAL COMBUSTION ENGINE

CROSS REFERENCE TO RELATED APPLICATIONS

This is a U.S. national stage of application No. PCT/EP2015/000372 filed Feb. 19, 2015 which claims priority to DE 102014002261.7 filed Feb. 20, 2014, the content of which is incorporated in its entirety herein by reference.

BACKGROUND OF THE INVENTION

1. Field of the Invention

The invention is directed to a control device of an internal combustion engine.

2. Related Art

It is known from practice that internal combustion engines constructed, for example, as ship's diesel internal combustion engines, have a fuel supply system in which at least one injector of the fuel supply system is associated with each cylinder of the internal combustion engine in order to inject fuel into the respective cylinder. As is well known, the fuel supply system can be constructed, for example, as common rail fuel supply system or for supplying gas valves for gas engines or dual fuel engines. The injectors or gas valves of the fuel supply system of the internal combustion engine are controlled by a control device, namely, in such a way that the voltage present at the injector or gas valve changes between different voltage levels in a boost phase of the control and also in a hold phase of the control. Accordingly, it is known from practice that the voltage changes between almost zero volts (0 V) and a boost voltage in the boost phase of the control and the voltage changes between almost zero volts (0 V) and a hold voltage in the hold phase of the control, the boost voltage being greater than the hold voltage. In general, the boost phase is the phase in which the injector/gas valve opens and the current level is higher than in the hold phase.

Although the injectors of a fuel supply system can be controlled with sufficient quality already in control devices of an internal combustion engine known from practice, there is a need for a control device that allows an improved control of the injectors of a fuel supply system of an internal combustion engine. In particular, there is a need for a control device in which a lower power loss occurs.

SUMMARY OF INVENTION

Based on the foregoing, it is an object of the present invention to provide a novel control device of an internal combustion engine. This object is met by a control device of an internal combustion engine in which the control device controls the respective injector or the gas valve in the boost phase such that the voltage present at the respective injector changes after reaching a defined boost current level between a relatively low boost voltage level, which is greater than zero volts (0 V), and a relatively high boost voltage level, which is greater than a supply voltage of the control device.

The invention suggests novel control in which the control device controls the respective injector/gas valve in the boost phase such that the voltage level of the boost phase changes between two boost voltage levels, and the low boost voltage level is greater than zero volts (0 V). This prevents the boost current level at the injector from dropping quickly when the relatively low boost voltage level is present at the injector. Therefore, the relatively low boost voltage level can remain present longer in the boost phase than was possible in the prior art. The power loss of the control device can be reduced in this way. A lower power loss of the control device brings about increased efficiency of the entire system. Further, the life of the control device and of the injectors/gas valves controlled by the control device can be increased. Since there is less power loss, the cooling requirement of the control device is also reduced so that additional cooling of the control device can possibly be entirely dispensed with.

Preferably, the relatively low boost voltage level that is greater than zero volts (0 V) corresponds approximately to the supply voltage of the control device. This configuration is particularly advantageous. When the relatively low boost voltage level of the boost phase corresponds approximately to the supply voltage of the control device, the control device can be constructed in a particularly simple Manner because there is no need for further expenditure on circuitry to provide the relatively low boost voltage level in the boost phase.

According to an advantageous further development, the control device controls the respective injector or gas valve in the hold phase such that the voltage present at the injector changes between a relatively low hold voltage level and a relatively high hold voltage level, and the relatively high hold voltage level preferably corresponds to the relatively low boost voltage level. An arrangement in which the relatively high hold voltage level of the hold phase corresponds to the relatively low boost voltage level of the boost phase is particularly advantageous especially when these two voltage levels approximately correspond in each instance to the supply voltage of the control device.

BRIEF DESCRIPTION OF THE DRAWINGS

Preferred further developments of the invention are indicated in the the following description. Embodiment examples of the invention are described more fully with reference to the drawings without the invention being limited to these embodiment examples. In the drawings.

DETAILED DESCRIPTION OF THE DRAWINGS

Figure 1:
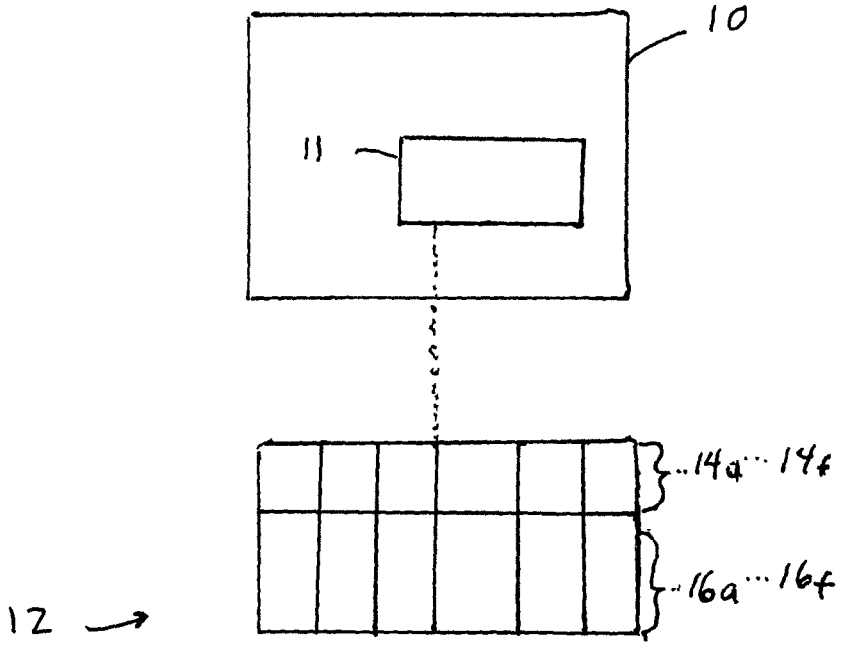
FIG. 1 schematically shows the control device and an engine with plural injectors or gas valves.

The invention is directed to a control device, such as control device 10 in FIG. 1, of an internal combustion engine such as engine 12 in FIG. 1, namely, a control device for controlling injectors, such as, for example, injectors 14*a*, to 14*f* in FIG. 1, associated, respectively, with associated cylinders 16*a* to 16*f*, of a fuel supply system of the internal combustion engine 12. The control device 10 serves particularly to control injectors 14*a* to 14*f* of a common rail fuel supply system of an engine 12, such as of an internal combustion engine, of a gas engine or of a dual-fuel engine which is operated selectively with liquid and/or gaseous fuel.

The control device 10 controls each injector of the fuel supply system for opening this injector such that the voltage present at the respective injector changes between different voltage levels in the boost phase of the control as well as in the hold phase of the control.

In the boost phase, the control device 10 controls the respective injector such that after reaching a boost current level at the injector the voltage present at the injector changes between a relatively low boost voltage level and a relatively high boost voltage level, the relatively low boost voltage level is greater than zero volts (0 V), and the relatively high boost voltage level is greater than a supply voltage of the control device.

Following the boost phase of the control is the hold phase of the control. The control device 10 controls the respective injector in the hold phase such that the voltage present at the injector changes between a relatively low hold voltage level and a relatively high hold voltage level.

A particularly advantageous operation of the control device 10 according to the invention is described in the following with reference to FIG. 2. Different voltage levels U for the control of an injector of a fuel supply system of an internal combustion engine 10 are shown over time t in FIG. 2.

The control of the respective injector is carried out in the boost phase between times t1 and t2.

The boost phase is followed between times t2 and t3 by the hold phase of the control of the respective injector.

Figure 2:
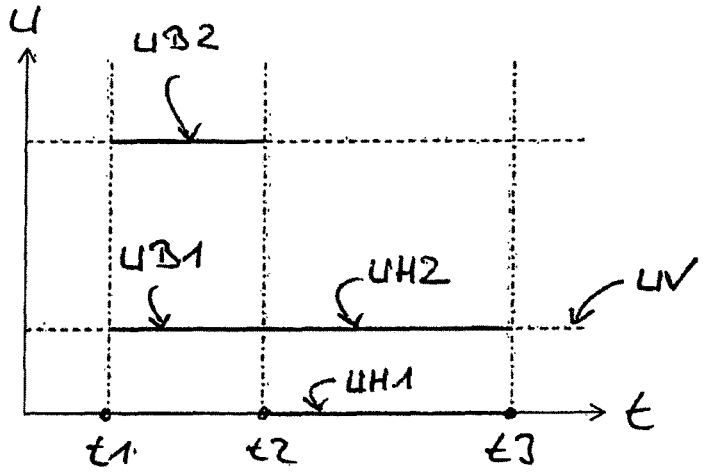
FIG. 2 is a time diagram illustrating the operation of the control device according to the invention.

According to FIG. 2, the control of the respective injector takes place in the boost phase between times t1 and t2 over two different voltage levels UB1 and UB2. The relatively low boost voltage level UB1 is greater than zero volts (0 V), namely, approximately corresponds to the supply voltage UV of the control device in FIG. 2, and the relatively high boost voltage level UB2 is greater than the supply voltage level UV of the control device 10. When the boost phase starts at time t1, the relatively high boost voltage level UB2 is initially present at the respective injector, specifically until a defined boost current level is reached at the injector. Subsequently, in the boost phase the two boost voltage levels UB1 and UB2 change back and forth such that the defined boost current level is maintained at the respective injector. To this end, the control device 10 preferably has a controller 11 that is configured to compare the actual boost current with the defined boost current level and to apply the relatively high boost voltage level UB1 to the injector when the actual boost current drops below the defined boost current level. On the other hand, when the actual boost current is greater than the defined boost current, the relatively low boost voltage level UB1 is present at the injector.

It can further be seen from FIG. 2 that the control device 10 also controls the respective injector during the hold phase between times t2 and t3 such that the voltage present at the injector changes between two voltage levels, namely, between the relatively low hold voltage level UH1 and the relatively high hold voltage level UH2, and the relatively low hold voltage level UH1 amounts to almost zero volts (0 V) in FIG. 2, and, further, the relatively high hold voltage level UH2 corresponds to the relatively low boost voltage level UB1 and, therefore, approximately to the supply voltage UV of the control device. The changing back and forth between the two voltage levels UH1 and UH2 of the hold phase and the changing back and forth between the two voltage levels UB1 and UB2 in the boost phase is carried out via the controller of the control device, which switches back and forth between two voltage levels UH1 and UH2 in the hold phase in such a way that a defined hold current level is maintained during the hold phase.

Accordingly, in the preferred configuration of the invention the supply voltage UV serves as relatively low boost voltage level UB1 during the boost phase and as relatively high hold voltage level UH2 during the hold phase so as to prevent a fast, sharp drop in boost current during the boost phase when the relatively low boost voltage level UB1 is present. Therefore, with respect to the boost phase, the amount of time in which the relatively high boost voltage level UB1 is present at the respective injector can be reduced compared to the amount of time in which the relatively low boost voltage level UB1 is present at the respective injector. In this way, there is less power loss in the respective control device. Efficiency can be increased. The life of the control device and of the controlled injectors can be increased. Less heat is generated in the control device because of the lower power loss so that the expenditure on cooling the control device can be reduced.

Figure 3:
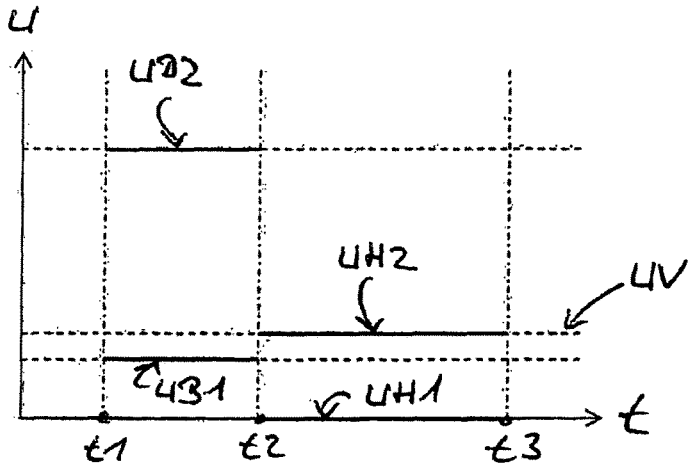
FIG. 3 is an alternative time diagram illustrating the operation of the control device according to the invention.
Figure 4:
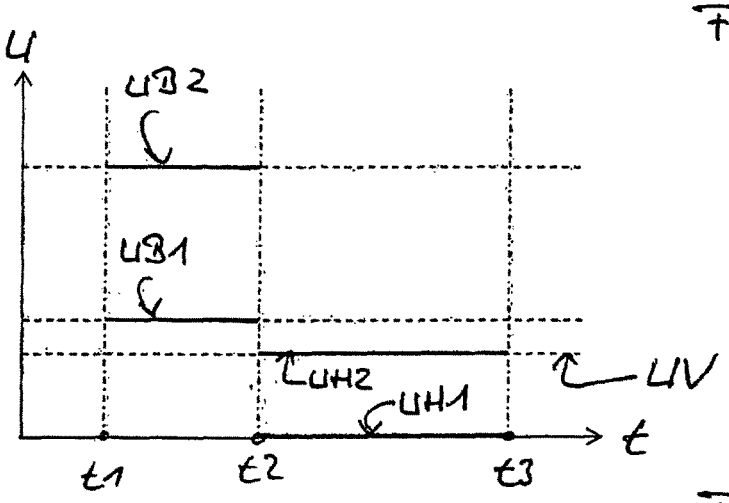
FIG. 4 is a further alternative time diagram illustrating the operation of the control device according to the invention.

Although it is preferable that the relatively low boost voltage level UB1 approximately corresponds to the supply voltage UV of the control device 10, it is also possible that the relatively low boost voltage level UB1 deviates from the supply voltage UV of the control device. FIG. 3 shows an arrangement in which the relatively low boost voltage level UB1 is lower than the supply voltage UV. FIG. 4 shows an arrangement in which the relatively low boost voltage level UB1 is greater than the supply voltage UV. In every case, the relatively low boost voltage level UB1 is greater than zero volts (0 V) during the boost phase.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A control device of an internal combustion engine for controlling injectors/gas valves of a fuel supply system of the internal combustion engine, the control device being configured to:

control each injector or each gas valve for opening such that a voltage present at the respective injector/gas valve changes between different voltage levels in a boost phase of the control as well as between first and second voltage levels in a hold phase of the control, wherein the control device controls the respective injector or the respective gas valve in the boost phase such that after reaching a defined boost current level the voltage present at the respective injector/gas valve changes between a first boost voltage level greater than zero volts (0 V) and a second boost voltage having a level greater than the first boost level and greater than a supply voltage of the control device, wherein the control device compares an actual boost current with the defined boost current level and applies the second boost voltage to the respective injector/gas valve when the actual boost current drops below the defined boost current level and applies the first boost voltage to the respective injector/gas valve when the actual boost current is greater than the defined boost current, wherein the second hold voltage level and the first boost voltage level correspond to the supply voltage of the control device.

2. The control device according to claim 1, wherein the control device controls the respective injector/gas valve in the hold phase such that the voltage present at the injector/gas valve changes between the first hold voltage level and the second hold voltage level having a level higher than the first hold voltage level.

3. The control device according to claim 2, wherein the first hold voltage level is approximately zero volts (0 V).

4. The control device according to claim 3, wherein the control device comprises a controller configured to, in the boost phase of the control, switch the voltage present at the injector/gas valve back and forth between the first boost voltage level and the second boost voltage level while maintaining the defined boost current level.

5. The control device according to claim 4, wherein in the hold phase of the control the controller of the control device switches the voltage present at the injector/gas valve back and forth between the first hold voltage level and the second hold voltage level while maintaining a defined hold current level.

6. The control device according to claim 4, wherein the second hold voltage level corresponds to the first boost voltage level.

* * * * *